US011969096B2

(12) United States Patent
Yeh

(10) Patent No.: US 11,969,096 B2
(45) Date of Patent: Apr. 30, 2024

(54) NAP APPARATUS FOR DESK

(71) Applicant: Mikyung Yeh, Gimpo-si (KR)

(72) Inventor: Mikyung Yeh, Gimpo-si (KR)

( * ) Notice: Subject to any disclaimer, the term of this patent is extended or adjusted under 35 U.S.C. 154(b) by 0 days.

(21) Appl. No.: 17/850,998

(22) Filed: Jun. 27, 2022

(65) Prior Publication Data

US 2023/0011689 A1 Jan. 12, 2023

(30) Foreign Application Priority Data

Jul. 5, 2021 (KR) ..... 10-2021-0087769

(51) Int. Cl.
*A47C 16/00* (2006.01)
*A47B 97/00* (2006.01)

(52) U.S. Cl.
CPC ..... *A47C 16/00* (2013.01); *A47B 97/00* (2013.01); *A47B 2200/0085* (2013.01)

(58) Field of Classification Search
CPC .. A47C 16/00; A47C 7/36; A47C 7/38; A47C 7/383; A47C 1/146; A47C 20/026; A47B 2200/0085; A45F 2004/026
USPC ..... 248/371, 118, 454–457; 5/634, 640
See application file for complete search history.

(56) References Cited

U.S. PATENT DOCUMENTS 635,578 A * 10/1899 Nixon ..... A47C 20/027 108/9
1,447,486 A * 3/1923 Schafer ..... A47C 1/146 297/377
2,107,962 A * 2/1938 Sheasby ..... A47C 20/047 5/189
2,614,271 A * 10/1952 Harvey ..... B25H 5/00 280/32.6
2,647,563 A * 8/1953 Bishop ..... A47C 1/16 297/352
2,663,029 A * 12/1953 Whitley ..... A47C 20/043 5/640
3,292,189 A * 12/1966 Parker ..... A47C 1/146 5/656
3,329,979 A * 7/1967 Drapin ..... A47C 20/027 5/634
6,684,431 B2 * 2/2004 Splane, Jr. ..... A47C 20/026 5/640
6,857,149 B2 * 2/2005 Hoggatt ..... A47C 20/026 5/652
9,150,130 B2 * 10/2015 Jackow ..... B60N 2/806
9,226,587 B2 * 1/2016 Halimi ..... A47C 16/00
D803,610 S * 11/2017 Jackow ..... D6/716.5
D962,669 S * 9/2022 Fromme-Ruthmann ..... D6/392
11,510,490 B2 * 11/2022 Hill ..... B60N 3/001
11,737,570 B2 * 8/2023 Stone ..... A47C 16/00 248/118
2003/0172462 A1 * 9/2003 Hoggatt ..... A47C 20/023 5/636

(Continued)

*Primary Examiner* — Ingrid M Weinhold
(74) *Attorney, Agent, or Firm* — Revolution IP, PLLC

(57) ABSTRACT

An object of the present invention is to provide a nap apparatus for a desk that allows a user to sleep comfortably as if leaning on a mother's back even when taking a nap at a desk. To this end, the nap apparatus for the desk of the present invention as a nap apparatus for a desk used when taking a nap on the desk includes a top plate support part to be supported on a top plate for the desk; and an upper body support part provided in the top plate support part and provided to be inclined on the top plate to support the upper body including a user's head.

1 Claim, 5 Drawing Sheets

(56) References Cited

U.S. PATENT DOCUMENTS

| | | | | |
|---|---|---|---|---|
| 2009/0302659 | A1* | 12/2009 | Goddu | A47C 16/00 297/391 |
| 2013/0232696 | A1* | 9/2013 | Halimi | A47C 16/00 5/640 |
| 2014/0311388 | A1* | 10/2014 | Korpi | A47B 23/043 108/162 |
| 2015/0001905 | A1* | 1/2015 | Jackow | B60N 2/806 297/397 |
| 2022/0192386 | A1* | 6/2022 | Tejeda | A47C 16/00 |
| 2023/0011689 | A1* | 1/2023 | Yeh | A47C 16/00 |

* cited by examiner

NAP APPARATUS FOR DESK

TECHNICAL FIELD

The present invention relates to a desk.

BACKGROUND ART

In general, a desk is a piece of furniture used for reading books or writing. Such a desk may be roughly classified into a school desk, an office desk, a home desk, etc. according to a place of use.

In particular, in the case of a school desk used by students, the school desk has a characteristic that the student stays therein for a long time to have a meaning as a place for each student. Accordingly, when taking a nap using a break or lunch time, the desk becomes a place for a nap.

However, since existing desks provide a technical configuration including a top plate on which a book can be placed and legs supporting the top plate, in order for a student to take a nap, the student currently takes a prone position on the top plate. As a result, there is a problem in that the upper body is severely bent and the stomach is pressed, and there is a problem in that the pain in the back and the waist is caused as the back is bent.

DISCLOSURE

Technical Problem

An object of the present invention is to provide a nap apparatus for a desk that allows a user to sleep comfortably as if leaning on a mother's back even when taking a nap at a desk.

Technical Solution

According to an embodiment of the present invention, there is provided a nap apparatus for a desk as a nap apparatus for a desk used when taking a nap on the desk including a top plate support part to be supported on a top plate for the desk; and an upper body support part provided in the top plate support part and provided to be inclined on the top plate to support the upper body including a user's head.

The nap apparatus for the desk may further include a folding part configured to maintain an inclination angle of the upper body support part at any one of a plurality of set inclination angles while the upper body support part and the plate support part are folded or unfolded to each other and the upper body support part is folded and unfolded with respect to the top plate support part.

The folding part may include a hinge configured to rotatably connect a lower end of the upper body support part and a front end of the top plate support part; and an inclination angle selection holding part provided between the top plate support part and the upper body support part to select and maintain any one of the plurality of set inclination angles.

The inclination angle selection holding part may include a plurality of engaging grooves provided in the top plate support part at intervals in a front and rear direction with respect to the top plate; and a selection holding rod rotatably provided in the upper body support part and locked on any one of the plurality of engaging grooves to select and maintain the inclination angle of the upper body support part.

The nap apparatus for the desk may further include a top plate fixing part for fixing the top plate support part to the top plate.

The top plate fixing part may be a clip which is provided bent at the front end of the top plate support part, and disposed on the bottom surface of the top plate together with the top plate support pat disposed on the upper surface of the top plate with respect to the top plate to hold the top plate.

The upper body support part may include a left support frame provided on the left side of the top plate support part; a right support frame provided on the right side of the top plate support part; and a fiber member disposed across the left support frame and the right support frame.

The upper body support part may further include a plurality of left hooks provided at intervals along the length direction in the left support frame; respective right hooks provided on the right support frame and provided at a position corresponding to each left hook, respectively; respective left rings provided at a left end of the fiber member and hooked on each left hook, respectively; and respective right rings provided on a right side of the fiber member and hooked on each right hook, respectively.

The upper body support part may further include a cushion member detachably provided to the fiber member and filled with a filler.

The upper body support part may further include two tension rods placed across the left support frame and the right support frame to cross each other behind the fiber member.

Advantageous Effects

As described above, the nap apparatus for the desk according to the embodiment of the present invention may have the following effects.

According to the embodiment of the present invention, the nap apparatus for the desk used when taking the nap at the desk includes a top plate support part and an upper body support part and is provided with a technical configuration provided in the top plate support part so that the upper body support part is inclined with respect to the top plate of the desk, so that it is possible to sleep comfortably as if leaning on the mother's back without lying on the desk when taking the nap at the desk.

Further, according to the embodiment of the present invention, since there is provided a technical configuration including a folding part, the top plate support part and the upper body support part may be normally folded so as to overlap each other through the folding part to easily carry the nap apparatus for the desk of the present invention. In addition, while the upper body support part is folded and unfolded with respect to the top plate support part through the folding part when taking the nap, the inclination angle of the upper body support part may be maintained at any one of a plurality of set inclination angles, that is, the inclination angle may be adjusted according to a user, thereby staying more comfortable while sleeping.

Further, according to the embodiment of the present invention, since there is provided a technical configuration including a top plate fixing part, while the user is taking the nap, the nap apparatus for the desk of the present invention may be prevented from falling over or being pushed back, thereby ultimately maintaining a deep sleep while taking the nap.

Further, according to the embodiment of the present invention, since there is provided a technical configuration of including a left support frame, a right support frame, and a fiber member in the upper body support part, the fiber member may be supported between the left support frame and the right support frame to provide a cushioning feeling to the user by the self-elasticity of the fiber member when the upper body of the user is placed in the fiber member. In addition, since there is no structural connection between the left support frame and the right support frame except for the fiber member, it is possible to reduce the volume thereof by removing the fiber member or by overlapping the left support frame and the right support frame with the fiber member as it is so as to be put into a bag or the like when carrying.

Further, according to the embodiment of the present invention, since there is provided a technical configuration of including a plurality of left hook hooks, respective right hooks, respective left rings, and respective right rings in the upper body support part, when the fiber member is worn out or stained with contaminants such as saliva, the fiber member may be washed separately from the support frame or replaced newly, thereby improving the cleanliness.

Further, according to the embodiment of the present invention, since there is provided a technical configuration of including a cushion member in the upper body support part, a user who prefers a softer feeling can feel the cushioning feeling of the cushion member in addition to the self-elasticity of the fiber member by installing the cushion member due to a detachable structure of the cushion member.

Further, according to the embodiment of the present invention, since there is provided a technical configuration of including two tension rods in the upper body support part, it is possible to support between the left support frame and the right support frame and smoothly support the load of the user's upper body applied to the left support frame and the right support frame.

Further, according to the embodiment of the present invention, there is provided a technical configuration that two tension rods have a structure to be rotatable with each other based on an intersection point, like scissors so that the left support frame and the right support frame may overlap with each other and an end of each tension rod is slidably provided in the left support frame and the right support frame. Accordingly, the two tension rods are rotated to overlap with each other while the left support frame and the right support frame overlap with each other, and simultaneously, the two tension rods and the left and right support frames may overlap with each other together while the end of each tension rod slides in the longitudinal direction thereof along the left support frame and the right support frame, thereby minimizing the volume thereof.

MODES FOR THE INVENTION

Hereinafter, embodiments of the present invention will be described in detail with reference to the accompanying drawings so as to easily implement those with ordinary skill in the art to which the present invention pertains. However, the present invention may be implemented in various different forms and is not limited to the embodiments described herein.

Figure 1:
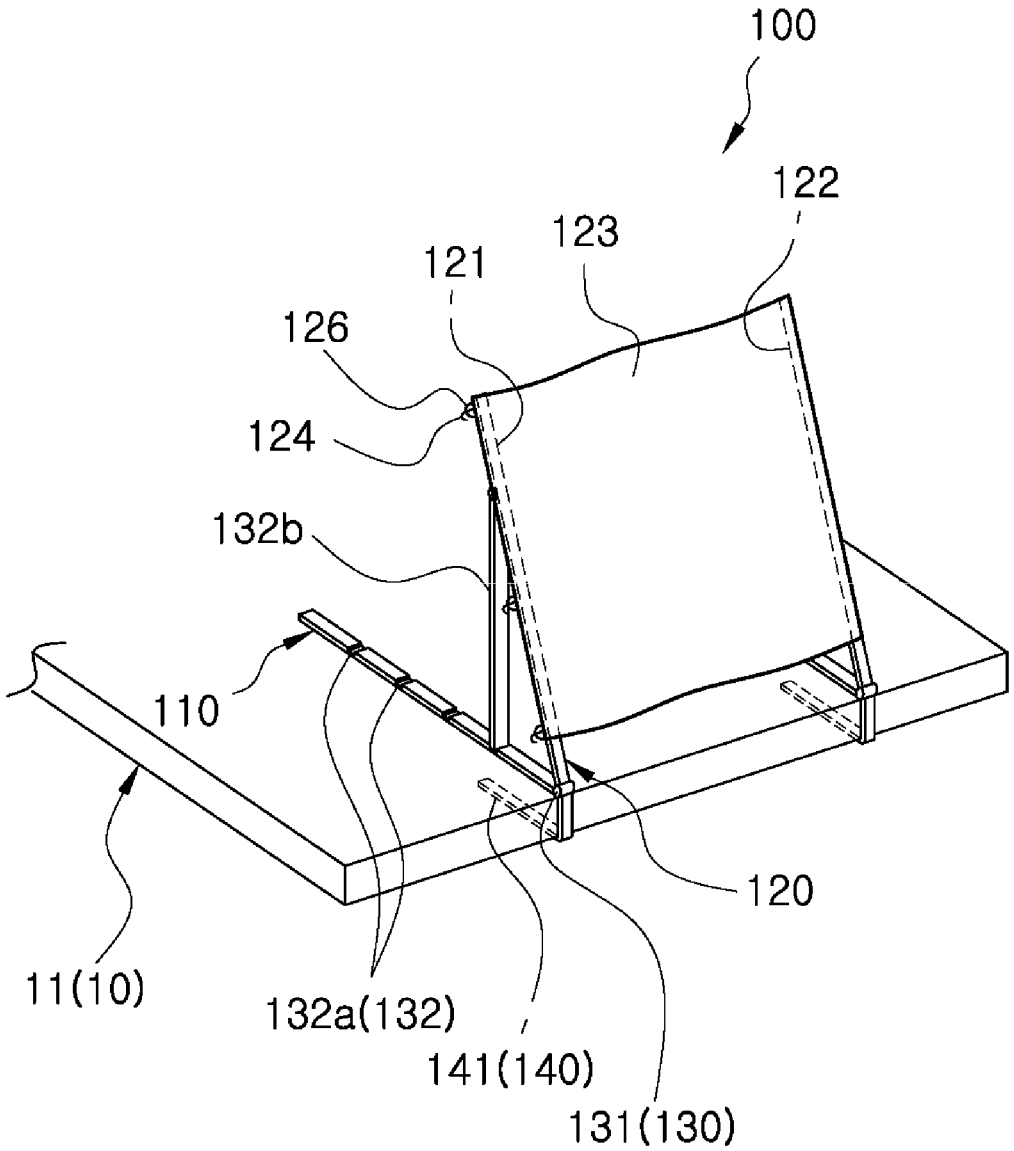
FIG. 1 is a perspective view schematically illustrating a nap apparatus for a desk according to an embodiment of the present invention.
Figure 2:
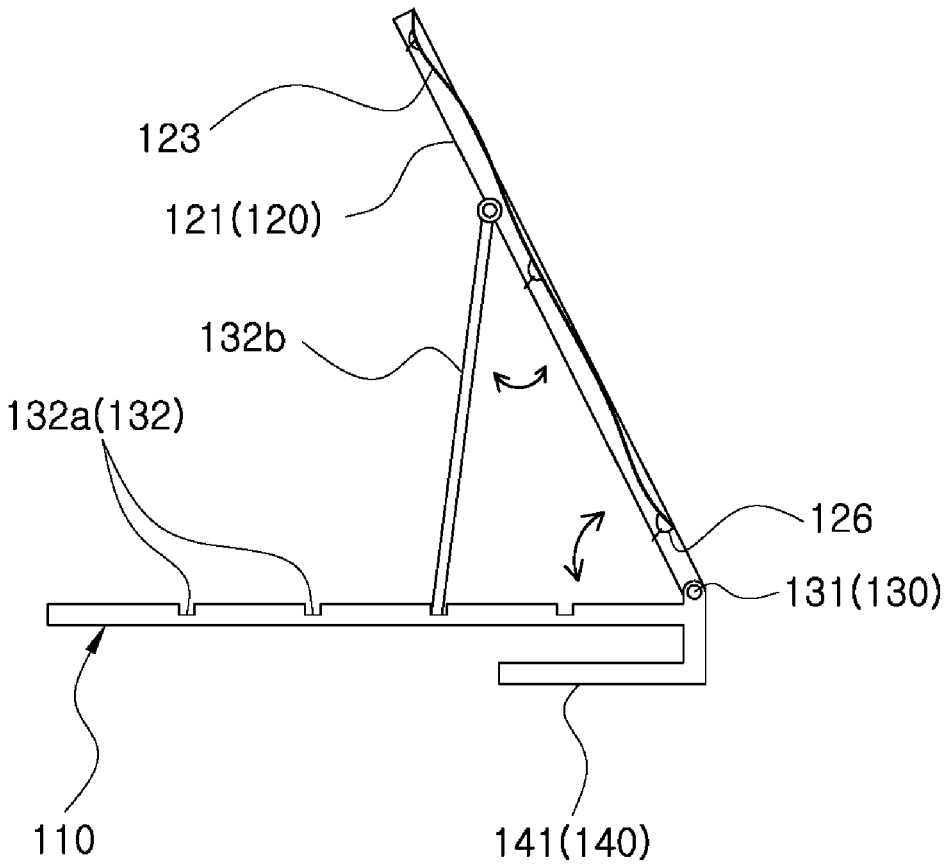
FIG. 2 is a side view schematically illustrating the nap apparatus for the desk of FIG. 1.
Figure 3:
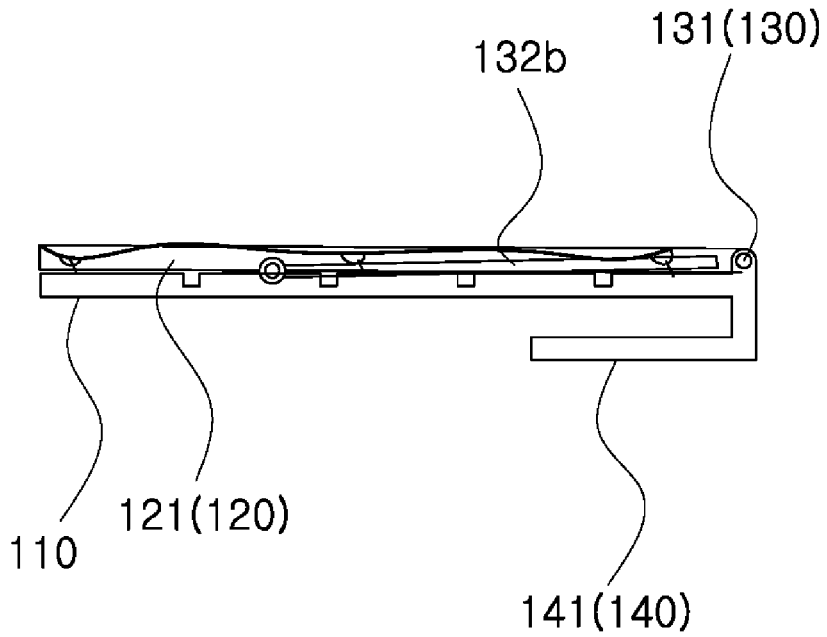
FIG. 3 is a diagram illustrating the nap apparatus for the desk of FIG. 2 in a folded state.

FIG. 1 is a perspective view schematically illustrating a nap apparatus for a desk according to an embodiment of the present invention and FIG. 2 is a side view schematically illustrating the nap apparatus for the desk of FIG. 1. FIG. 3 is a diagram illustrating the nap apparatus for the desk of FIG. 2 in a folded state.

A nap apparatus 100 for a desk according to an embodiment of the present invention, as illustrated in FIGS. 1 to 3, as a nap apparatus for a desk used when taking a nap at a desk 10, includes a top plate support part 110 and an upper body support part 120. Here, the desk 10 may be a concept including not only a school desk, but also an office desk, a home desk, and the like. Hereinafter, respective components will be described in more detail with reference to FIGS. 1 to 3.

The top plate support part 110 is a component for supporting the nap apparatus 100 for the desk of the present invention on a top plate 11 of the desk 10. As an example, as illustrated in FIG. 1, the top plate support part 110 may be formed of a member having an elongated shape in a direction from the front to the rear with respect to the top plate 11 and as another example, may also be formed of a member having a wide plate shape although not illustrated. Here, as the member having the elongated shape, a rod having a circular cross-section, a bar having a prismatic cross-section, or the like may be used.

The upper body support part 120 is a component for substantially supporting the upper body including the user's head. The upper body support part 120 may be provided on the top plate support part 110 and inclined with respect to the top plate 11 of the desk 10.

Accordingly, since the above components are provided, when the user takes a nap on the desk 10, the user may sleep comfortably as if leaning on the mother's back without lying on the desk 10.

Hereinafter, referring back to FIGS. 1 and 2, the upper body support part 120 will be described in more detail.

As illustrated in FIGS. 1 and 2, the upper body support part 120 may include a left support frame 121, a right support frame 122, and a fiber member 123. The left support frame 121 may be provided on the left side of the top plate support part 110, and the right support frame 122 may be provided on the right side of the top plate support part 110. The fiber member 123 may be disposed across the left support frame 121 and the right support frame 122, and a cloth or the like may be used as the fiber member 123. Accordingly, the fiber member 123 may be supported between the left support frame 121 and the right support frame 122 to provide a cushioning feeling to the user by the self-elasticity of the fiber member 123 when the user's upper body is placed on the fiber member 123. In addition, since there is no structural connection between the left support frame 121 and the right support frame 122 except for the fiber member 123, it is possible to reduce the volume thereof by removing the fiber member 123 or by overlapping the left support frame 121 and the right support frame 122 with the fiber member 123 as it is so as to be put into a bag or the like when carrying.

In addition, the upper body support part 120, as illustrated in FIGS. 1 and 2, may further include a plurality of left hooks 124, respective right hooks (not illustrated), respective left rings 126, and respective right rings (not illustrated). Each of the left hooks 124 may be provided at intervals along the length direction in the left support frame 121, and each right hook (not illustrated) is provided on the right support frame 122, but may be provided at a position corresponding to each left hook 124. Each of the left rings 126 may be provided at a left end of the fiber member 123 and may be hooked on each left hook 124, and each right ring (not illustrated) may be provided on a right side of the fiber member 123 and may be hooked on each right hook (not illustrated). Accordingly, when the fiber member 123 is worn out or stained with contaminants such as saliva, the fiber member 123 may be washed separately from the left and right support frames 121 and 122 or replaced newly, thereby improving the cleanliness.

In addition, the nap apparatus 100 for the desk according to the embodiment of the present invention may further include a folding part 130 as illustrated in FIGS. 1 to 3. The folding part 130 may fold or unfold the upper body support part 120 and the top plate support part 110 to each other, and while the upper body support part 120 is folded or unfolded with respect to the top plate support part 110 (that is, while the upper body support part 120 is rotated with respect to the top plate support part 110), an inclination angle of the upper body support part 120 may be maintained at any one of a plurality of set inclination angles.

Accordingly, as illustrated in FIG. 3, the top plate support part 110 and the upper body support part 120 may be normally folded so as to overlap each other through the folding part 130 to easily carry the nap apparatus 100 for the desk of the present invention. In addition, as illustrated in FIGS. 1 and 2, while the upper body support part 120 is folded and unfolded with respect to the top plate support part 110 through the folding part 130 when taking the nap, the inclination angle of the upper body support part 120 may be maintained at any one of the plurality of set inclination angles, that is, the inclination angle may be adjusted according to a user, thereby staying more comfortable while sleeping.

For example, the folding part 130 may include a hinge 131 and an inclination angle selection holding part 132 as illustrated in FIGS. 2 and 3. The hinge 131 may rotatably connect a lower end of the upper body support part 120 and a front end of the top plate support part 110. The inclination angle selection holding part 132 may be provided between the top plate support part 110 and the upper body support part 120, and may select any one of the plurality of set inclination angles and maintain the selected inclination angle.

Furthermore, the inclination angle selection holding part 132 may include a plurality of engaging grooves 132*a* and a selection holding rod 132*b*. Each of the engaging grooves 132*a* may be provided in the top plate support part at intervals in the front and rear direction with respect to the top plate 11 of the desk 10. The selection holding rod 132*b* may be rotatably provided in the approximately upper half of the upper body support part 120 (from the center to the upper side of the upper body support part), and may be locked on the plurality of engaging grooves 132*a* to select the inclination angle of the upper body support part 120 and maintain the selected inclination angle.

In addition, the nap apparatus 100 for the desk according to the embodiment of the present invention may further include a top plate fixing part 140 as illustrated in FIGS. 1 to 3. The top plate fixing part 140 may fix the top plate support part 110 to the top plate 11. Accordingly, it is possible to prevent the nap apparatus 100 for the desk of the present invention from falling over or being pushed backward while the user takes the nap, and ultimately, to maintain a deep sleep while taking the nap.

For example, the top plate fixing part 140 may be a clip 141 as illustrated in FIGS. 2 and 3. The clip 141 may be provided bent at the front end of the top plate support part 110, and is disposed on the bottom surface of the top plate 11 together with the top plate support pat 110 disposed on the upper surface of the top plate 11 with respect to the top plate 11 to hold the top plate 11.

Hereinafter, referring to FIG. 4, a nap apparatus 200 for a desk according to another embodiment of the present invention will be described in detail.

Figure 4:
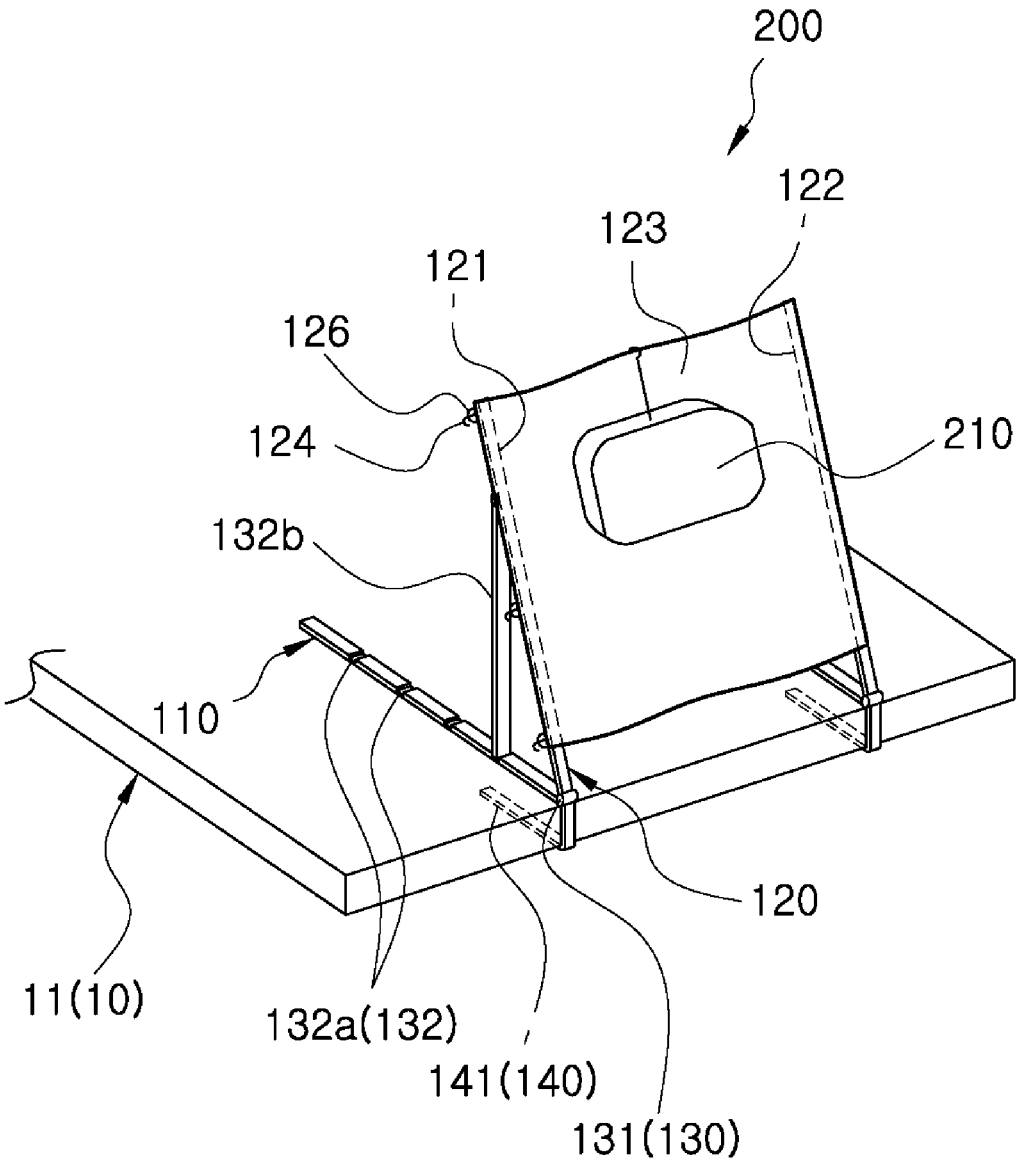
FIG. 4 is a perspective view schematically illustrating a nap apparatus for a desk according to another embodiment of the present invention.

FIG. 4 is a perspective view schematically illustrating a nap apparatus for a desk according to another embodiment of the present invention.

Since the nap apparatus 200 for the desk according to another embodiment of the present invention is the same as an embodiment of the present invention described above, except for further including a cushion member 210, as illustrated in FIG. 4, hereinafter, the cushion member 210 will be mainly described.

As illustrated in FIG. 4, the cushion member 210 may be detachably provided to the fiber member 123 described above through a hook or the like, and filled with a filler therein.

Accordingly, a user who prefers a softer feeling may further feel the cushioning feeling of the cushion member 210 in addition to the self-elasticity of the fiber member 123 by further installing the cushion member 210 due to a detachable structure of the cushion member 210.

Hereinafter, referring to FIG. 5, a nap apparatus 300 for a desk according to yet another embodiment of the present invention will be described in detail.

Figure 5:
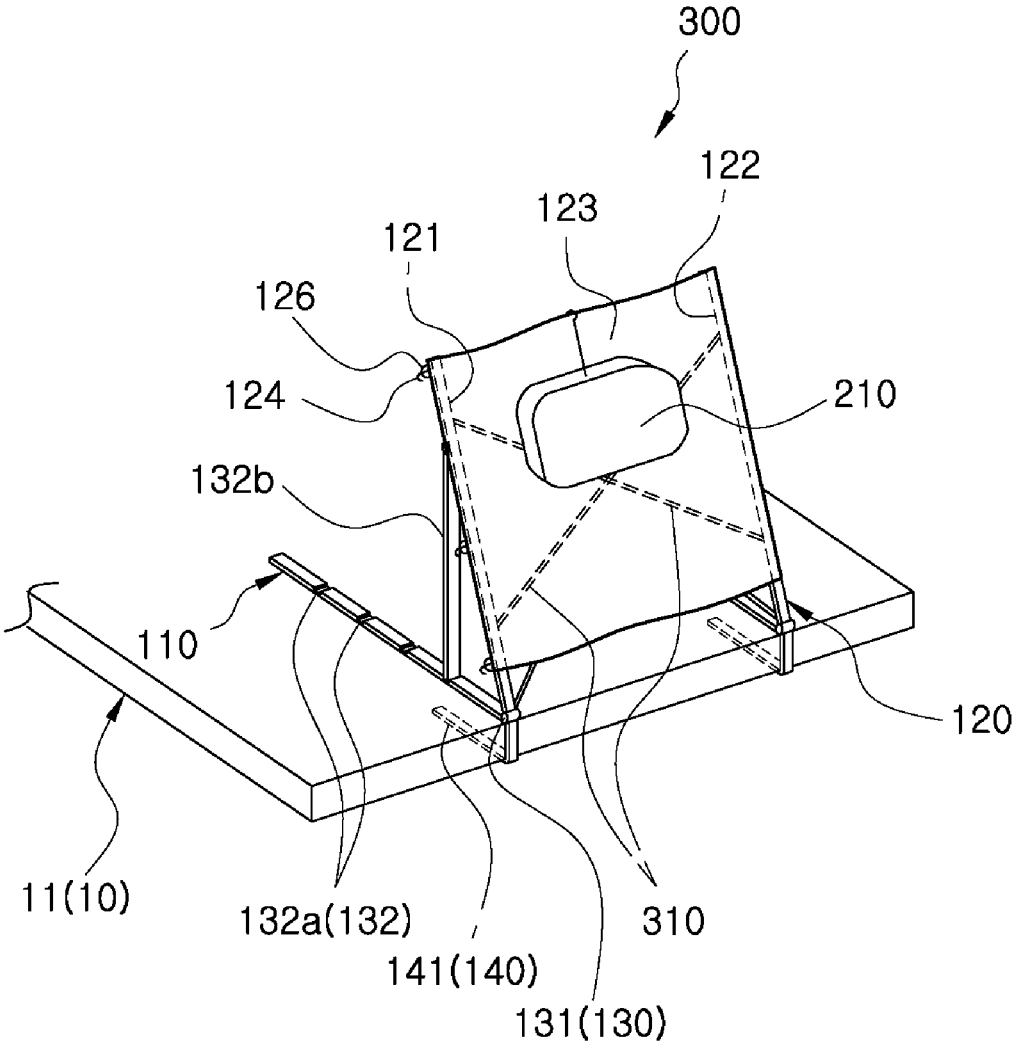
FIG. 5 is a perspective view schematically illustrating a nap apparatus for a desk according to yet another embodiment of the present invention.

FIG. 5 is a perspective view schematically illustrating a nap apparatus for a desk according to yet another embodiment of the present invention.

Since the nap apparatus 300 for the desk according to yet another embodiment of the present invention is the same as an embodiment or another embodiment of the present invention described above, except for further including two tension rods 310, as illustrated in FIG. 5, hereinafter, the two tension rods 310 will be mainly described.

The two tension rods 310 may be placed across the left support frame 121 and the right support frame 122 to cross each other behind the fiber member 123.

Accordingly, it is possible to support between the left support frame 121 and the right support frame 122, and smoothly support the load of the user's upper body applied to the left support frame 121 and the right support frame 122.

Furthermore, although not illustrated, the two tension rods 310 may have a structure to be rotatable with each other based on an intersection point, like scissors, so that the left support frame 121 and the right support frame 122 may overlap with each other and an end of each tension rod 310 may slidably provided in the left support frame 121 and the right support frame 122. Accordingly, the two tension rods 310 are rotated to overlap with each other while the left support frame 121 and the right support frame 122 overlap with each other, and simultaneously, the two tension rods 310 and the left and right support frames 121 and 122 may overlap with each other together while the end of each tension rod 310 slides in the longitudinal direction thereof along the left support frame 121 and the right support frame 122, thereby minimizing the volume thereof.

While the preferred exemplary embodiment of the present invention has been described in detail, the scope of the present invention is not limited thereto, and various modifications and improvements of those skilled in the art using a basic concept of the present invention defined in the appended claims also belong to the scope of the present invention.

[Explanation of Reference Numerals and Symbols]

| | |
|---|---|
| 10: Desk | 11: Top plate of desk |
| 100, 200, 300: Nap apparatus for desk | |
| 110: Top plate support part | 120: Upper body support part |
| 121: Left support frame | 122: Right support frame |
| 123: Fiber member | 124: Left hook |
| 126: Left ring | 130: Folding part |
| 131: Hinge | 132: Inclination angle selection holding part |
| 132a: Plurality of engaging grooves | 132b: Selection holding rod |
| 140: Top plate fixing part | 141: Clip |
| 210: Cushion member | 310: Tension rod |

The invention claimed is:

1. A nap apparatus for a desk used when taking a nap on the desk, comprising:

a top plate support part configured to be supported on a top plate of the desk, wherein the top plate support part comprises:

a left top plate support part having a first elongated shape in a first direction, and having a front end and a rear end, and a right top plate support part having a second elongated shape in a second direction, and having a front end and a rear end, the right top support plate being spaced from and substantially parallel to the left top plate support part;

an upper body support part connected to the top plate support part, configured to be inclined on the top plate, and configured to support a user's head, wherein the upper body support part comprises:

a left support frame having an upper end and a lower end, a right support frame having an upper end and a lower end, wherein the lower end of the left support frame is connected to the front end of the left top plate support part, and the lower end of the right support frame is connected to the front end of the right top plate support part;

wherein the upper ends of the left and right support frames are free ends, and the rear ends of the left and right top plate supports are free ends;

a folding part configured to maintain an inclination angle of the upper body support part at any one of a plurality of set inclination angles while the upper body support part is folded and unfolded with respect to the top plate support part, wherein the folding part comprises:

a first hinge configured to rotatably connect the lower end of the left support frame to the front end of the left top plate support part, a second hinge configured to rotatably connect the lower end of the right support frame to the front end of the right top plate support part;

an inclination angle selection holding part provided between the top plate support part and the upper body support part to select and maintain any one of the plurality of set inclination angles;

a fiber member disposed across and between the left support frame and the right support frame and connected thereto;

a cushion member detachably connected to the fiber member and filled with a filler;

two tension rods placed across and between the left support frame and the right support frame to cross each other behind the fiber member, wherein the tension rods and the fiber member connect the left support frame to the right support frame, and the left and right top plate support parts are free from any other structure therebetween;

a top plate fixing part configured to fix the top plate support part to the top plate, wherein the top plate fixing part comprises:

a first L-shaped clip extending downwardly from the first hinge at the front end of the left top plate support, a second L-shaped clip extending downwardly from the second hinge at the front end of the right top plate support, wherein the first and second L-shaped clips are configured to engage an edge of the top plate of the desk when the left and right top plate support parts are disposed on an upper surface of the top plate, the rear ends of the left and right top plate support parts being free of any connecting structure.

* * * * *